US009044937B2

(12) United States Patent
Buschmann

(10) Patent No.: US 9,044,937 B2
(45) Date of Patent: Jun. 2, 2015

(54) METHOD TO EXECUTE A PRINT INTERRUPTION IN PRINTING OPERATION OF AN INK PRINTING SYSTEM WITH AT LEAST ONE PRINTING APPARATUS

(71) Applicant: Stefan Buschmann, Arenshausen (DE)

(72) Inventor: Stefan Buschmann, Arenshausen (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 0 days.

(21) Appl. No.: 13/973,446

(22) Filed: Aug. 22, 2013

(65) Prior Publication Data

US 2014/0055512 A1 Feb. 27, 2014

(30) Foreign Application Priority Data

Aug. 23, 2012 (DE) ..... 10 2012 107 775

(51) Int. Cl.
*B41J 29/38* (2006.01)
*B41J 2/165* (2006.01)
*B41J 2/045* (2006.01)

(52) U.S. Cl.
CPC ..... *B41J 2/04596* (2013.01); *B41J 2/165* (2013.01)

(58) Field of Classification Search
CPC ..... B41J 2/04596
USPC ..... 347/9, 20, 27, 19, 16, 23
See application file for complete search history.

(56) References Cited

U.S. PATENT DOCUMENTS

| | | | | |
|---|---|---|---|---|
| 5,828,387 | A | 10/1998 | Wataya et al. | |
| 6,431,674 | B2 | 8/2002 | Suzuki et al. | |
| 7,147,298 | B2 * | 12/2006 | Usuda | 347/35 |
| 2003/0122891 | A1 * | 7/2003 | Hamamoto et al. | 347/23 |
| 2012/0182343 | A1 * | 7/2012 | Biglari et al. | 347/14 |

FOREIGN PATENT DOCUMENTS

| | | |
|---|---|---|
| DE | 69713922 | 8/1997 |
| DE | 69736991 | 1/2002 |
| EP | 0788882 | 7/2002 |
| EP | 1795356 | 6/2007 |
| EP | 2418087 | 2/2012 |

* cited by examiner

*Primary Examiner* — Jason Uhlenhake
(74) *Attorney, Agent, or Firm* — Schiff Hardin LLP

(57) ABSTRACT

In a method to execute a printing interruption in a printing operation of an ink printing system in which a printing substrate is printed with at least one print head during the printing interruption in which a feed speed of the printing substrate web comes to a standstill, at least one vibration pulse is sent to the at least one print head to trigger vibration oscillations before a print controller loads print data into the at least one print head. Thereafter a print-start signal is sent to the at least one print head.

3 Claims, 3 Drawing Sheets

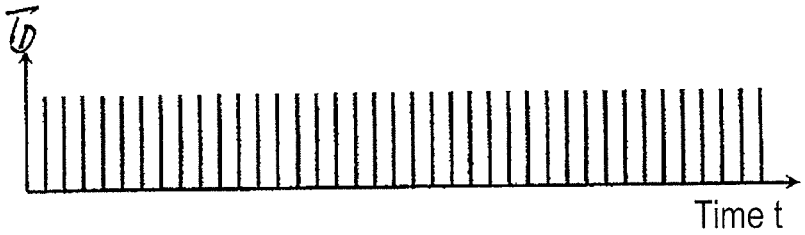
Fig. 2a
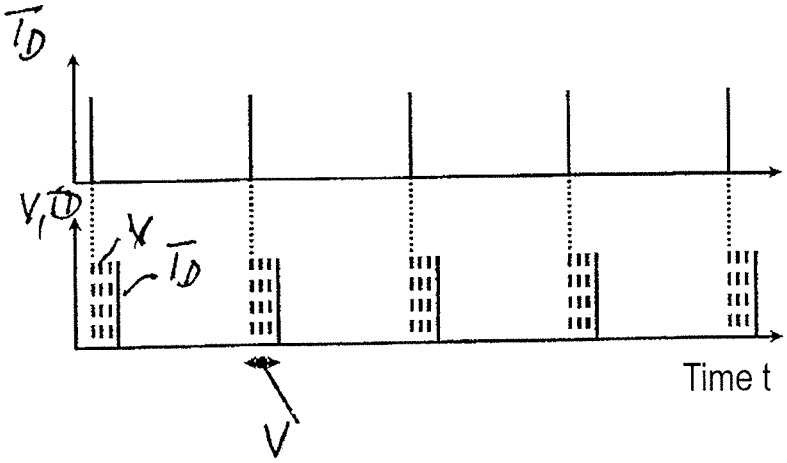
Fig. 2b
Fig. 2c
Fig. 2

METHOD TO EXECUTE A PRINT INTERRUPTION IN PRINTING OPERATION OF AN INK PRINTING SYSTEM WITH AT LEAST ONE PRINTING APPARATUS

BACKGROUND

Ink printing apparatuses can be used for single-color or multicolor printing to a printing substrate (for example a single sheet or a web-shaped recording medium) made of the most varied materials (paper, for example). The design of such ink printing apparatuses is known; see for example EP 0 788 882 B1. Ink printing apparatuses that operate according to the Drop on Demand (DoD) principle have a print head or multiple print heads with nozzles comprising ink channels, the activators of which nozzles—controlled by a printer controller—excite ink droplets in the direction of the printing substrate, which ink droplets are directed towards said printing substrate in order to apply print dots there for a print image. The activators can generate ink droplets piezoelectrically (DE 697 36 991 T2).

In an ink printing apparatus, the ink that is used is adapted in terms of its physical/chemical composition to the print head; for example the ink is adapted with regard to its viscosity. Given low printer utilization, in the printing process not all nozzles of the print head are activated; many nozzles have downtimes, with the consequence that the ink in the ink channel of these nozzles is not moved. Due to the effect of the evaporation out of the nozzle opening, the danger exists that the viscosity of the ink then changes. This has the result that the ink in the ink channel can no longer move optimally, and therefore the ink can no longer exit optimally from the nozzle. In extreme cases, the ink in the ink channel dries up completely and blocks the ink channel, such that a printing with this nozzle is no longer possible.

A drying of the ink in the nozzles of a print head during their print pause represents a problem that can be prevented in that a flushing medium (for example ink or cleaning fluid) is flushed through all nozzles within a predetermined cycle. This flushing cycle can be set corresponding to the print utilization.

Furthermore, from DE 697 36 991 T2 (EP 0 788 882 B1) it is known to remedy difficulties caused by the change of the viscosity of the ink in the nozzles upon the ejection of ink droplets in that the piezoelectric activators of the nozzles are respectively vibrated before or after the printing process (also called prefire or meniscus vibrations), such that no ink droplets are ejected but the ink in the nozzles is stirred. It can thereby be achieved that the ink situated at the nozzle openings mixes with the ink located inside the piezoelectric activator, such that the ink droplets can be generated again under normal conditions in the printing operation.

In the printing of a printing substrate it is sometimes necessary to briefly interrupt the printing operation (for example for 3 min), for example in order to monitor the register quality after proofing a print job or in order to correct problems in the post-processing of the printing substrate. The feed speed of the printing substrate can thereby be reduced up to a complete stop and be restarted again after a wait time (of 3 min, for example). Given such an interruption of the printing operation, a partially printed print image can be situated under the print heads, which partially printed print image should be printed further after the end of the interruption.

SUMMARY

It is an object to specify a method that ensures that, given a printing interruption in which the printing substrate is braked from a printing speed to, for example, a standstill and is subsequently accelerated to printing speed again, such a change of the viscosity of the ink in the nozzles of a print head (in particular at the nozzle openings) that can prevent the ejection of ink droplets after the end of the interruption is avoided.

In a method to execute a printing interruption in a printing operation of an ink printing system in which a printing substrate is printed with at least one print head during the printing interruption in which a feed speed of the printing substrate web comes to a standstill, sending at least one vibration pulse is sent to the at least one print head to trigger vibration oscillations before a print controller loads print data into the at least one print head. Thereafter a print-start signal is sent to the at least one print head.

BRIEF DESCRIPTION OF THE DRAWINGS

FIGS. 2*a* through 2*c* are principle pulse diagrams that present a series of print clock pulses during the printing operation and the printing interruption.

DESCRIPTION OF EXEMPLARY EMBODIMENTS

Figure 1:
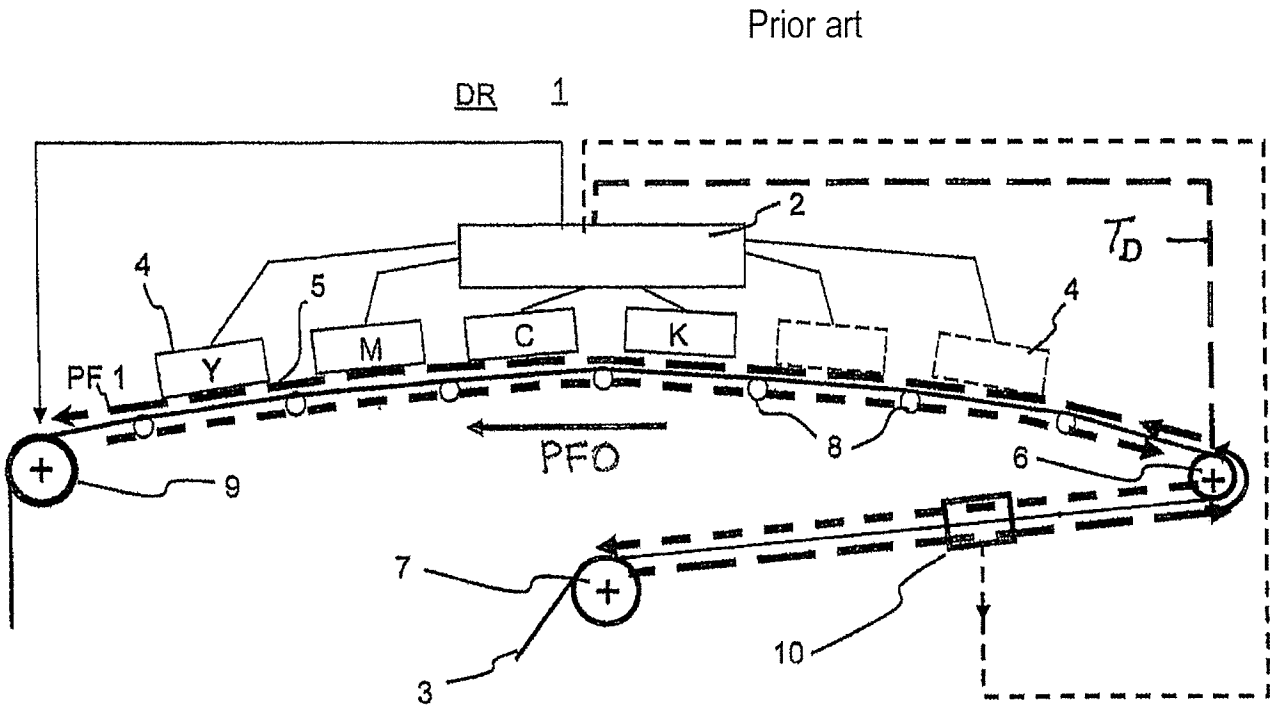
FIG. 1 is a principle representation of a printing unit on an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In the following, what is to be understood by an interruption of the printing operation of a print head is that a print head generates print characters directly on the printing substrate, is not yet finished with the printing, and the printing substrate should nevertheless be halted. After the printing interruption, the printing substrate is accelerated again to printing speed and the print head finishes its print job.

Print clock pulses that are supplied to a printer controller are generated with a sensor (for example with an encoder roller driven by the printing substrate) depending on the feed of the printing substrate. Given the presence of print data for one or more print heads, a print-start signal is supplied to these so that these eject ink droplets in the direction of the printing substrate. It has now been shown that print clock pulses can also be generated by the sensor during the printing interruption if the printing substrate moves. This event can occur if the strain state of the printing substrate changes during the printing interruption, for example when the printing substrate is exposed to moisture and then swells. Given the occurrence of a print clock pulse during the printing interruption, however, the print heads whose printing has been interrupted should continue to print. However, before the print heads continue to print, the printer controller sends a vibration pulse to the print heads based on which print heads execute vibration oscillations in a known manner. Only subsequently does the printer controller load print data into the print heads and send a print-start signal to the print heads. In this way it can be prevented that the viscosity of the ink in the nozzles of the print heads undesirably increases.

The method according to an exemplary embodiment of the invention thereby has the following advantages:

The reliability of the printing in the printing interruption is increased; no data loss occurs.

Printing with ink that dries quickly is possible.

The embodiment can be realized at low cost.

An exemplary embodiment is explained further using FIGS. 1 through 3.

The aforementioned problems given a printing interruption are explained further using FIG. 1. A printing substrate web 3 is thereby used as a printing substrate, without the exemplary embodiment thereby being limited to a printing substrate web. In addition to this, in the exemplary embodiment it is assumed that the printing unit has a plurality of print heads. However, the statements also apply if the printing unit provides only one print head.

A printing unit 1 and a printer controller 2 of a printing apparatus DR are shown. The printing unit 1 is arranged along a printing substrate web 3, which printing unit 1 has print bars 4 with print heads 5 in series as viewed in the transport direction PF0 of the printing substrate web 3. Given color printing, for example, a respective print bar 4 can be provided per color to be printed. The printing substrate web 3 is moved past the print bars 4 with the aid of a take-up roller 9; it thereby lies on a saddle with guide rollers 8. A sensor is arranged at the intake of the printing unit 1, which sensor generates print clock pulses $T_D$ depending on the feed speed of the printing substrate web 3, which print clock pulses $T_D$ are supplied to the printer controller 2 and are used by the printer controller 2 to—for example—establish the point in time of the ejection of ink droplets at the nozzles of the individual print heads 5 when print data for printing are already present in the printer controller 2. The sensor can, for example, be executed as a rotary encoder or encoder roller 6 which is driven by the printing substrate web 3.

Figure 3A:
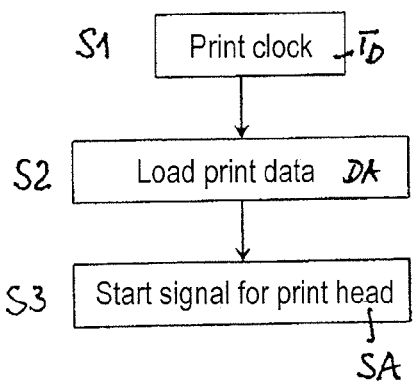
FIGS. 3*a* through 3*b* are a principle presentation of a workflow diagram for the control of the print heads without and with use of an exemplary embodiment.

According to FIG. 3*a*, print clock pulses $T_D$ are generated by the encoder roller 6 synchronously with the feed of the printing substrate web 3 (Step S1), which means that one print clock pulse $T_D$ is emitted by the encoder roller 6 to the printer controller 2 per pixel of a character to be printed, for example. After every print clock pulse $T_D$, the printer controller supplies print data DA to the respective print head 5 (Step S2) and then triggers the emission of ink droplets via a print-start signal SA (Step S3). The print heads 2 (in a known manner) have nozzles with ink channels that, for example, can generate ink droplets with a piezoelectric activator according to the DoD principle, which ink droplets are directed towards the printing substrate web 3 in order to generate a print dot there. The printing substrate web 3 is thereby supplied to the encoder roller 6 via a drive roller 7 arranged before the encoder roller 6.

The printing apparatus DR according to FIG. 1 can additionally have a web tension sensor 10 that is arranged adjacent to the printing substrate web 3, for example between the drive roller 7 and the encoder roller 6. The real value of the web tension of the printing substrate web 3, which real value is determined by the web tension sensor, is compared in the printing operation and during the printing interruption with a predetermined desired value of the web tension and—upon deviation of the real value from the desired value the web tension of the printing substrate web 3—can be regulated again to the desired value by influencing the rotation speed of the take-up roller 9. The control circuit that is required for this can be arranged in the printer controller 2.

If the printing operation is interrupted, the problems illustrated above can occur. For example, the printing substrate web 3 can swell during the printing interruption if it is exposed to moisture. The printing substrate web 3 is then moved in the direction of the arrow PF1 due to the web tension regulation.

However, if the printing substrate web 3 is moved somewhat during the printing interruption, this has the result that the encoder roller 6 emits print clock pulses $T_D$. Print-start signals SA are then supplied to the print heads 5 for which print data DA exist, such that these eject ink droplets onto the printing substrate web 3 in continued printing. However, since the time interval between the print clock pulses $T_D$ is greater in the printing interruption in comparison to the printing operation, the danger exists that the viscosity of the ink in the nozzle openings has changed, such that incorrect ink droplets or no ink droplets can be ejected by the piezoelectric activators.

In order to avoid this, the point in time of the activation of the individual nozzles with a print-start signal SA is shifted in time so that beforehand at least one vibration pulse V can be sent to the activators of the nozzles, via which vibration pulse V vibration oscillations are triggered via which the ink at the nozzle openings is stirred before an ink droplet should be ejected.

The relationships during a printing interruption can be learned from the pulse diagrams of FIG. 2. It is thereby assumed that the printing substrate web 3 should be brought to a standstill during the printing interruption. In the pulse diagram FIG. 2*a*, the sequence of print clock pulses $T_D$ is shown depending on the time t given a nominal speed (the print speed). At each print clock pulse $T_D$, ink droplets can be generated by nozzles of the respective print head 5 given the presence of print data DA for a print head 5, which ink droplets are directed towards the printing substrate web 3.

Even if the printing substrate web 3 should come to a standstill in a printing interruption, due to the environmental influences on the printing substrate web 3 that are illustrated above the printing substrate web 3 is intermittently, very slowly moved in the longitudinal direction, with the consequence that the encoder roller 6 generates print clock pulses $T_D$, given the occurrence of which the print heads 5 whose printing has been interrupted print further. A sequence of print clock pulses $T_D$ during a print is shown in principle from FIG. 2*b*. In the presentation FIG. 2*b*, the print clock pulses $T_D$ have the same time interval from one another. However, in reality their time interval changes depending on the change of the strain state of the printing substrate web 3. However, since the time interval between the individual print clock pulses $T_D$ is greater in comparison to the printing operation (FIG. 2*a*), the danger explained above exists that the ejection of ink droplets is incorrect due to the change of the viscosity of the ink at the nozzle openings.

In order to avoid this problem, given the occurrence of a print clock pulse $T_D$ during the printing interruption (FIG. 2*b*) vibrations are generated (FIG. 2*c*, shown in dashed lines) according to the exemplary embodiment by the activator in the ink channel before generation of a print-start signal SA for the respective print head 5 and ejection of an associated ink droplet, in order to stir the ink there in the ink channel (in particular at the nozzle openings). The emission of the ink droplet for a print dot is thus generated with a time delay in order to be able to implement the vibrations in the activator beforehand. This method is perceptible from FIG. 2*c* in comparison to FIG. 2*b*. Whenever the encoder roller 6 generates a print clock pulse $T_D$, at least one vibration pulse V is provided to the print-ready activator of the print head 5, due to which vibrations are generated in the nozzles in order to stir the ink. The ink droplet for the print dot to be generated is thus ejected with a time offset.

Figure 3B:
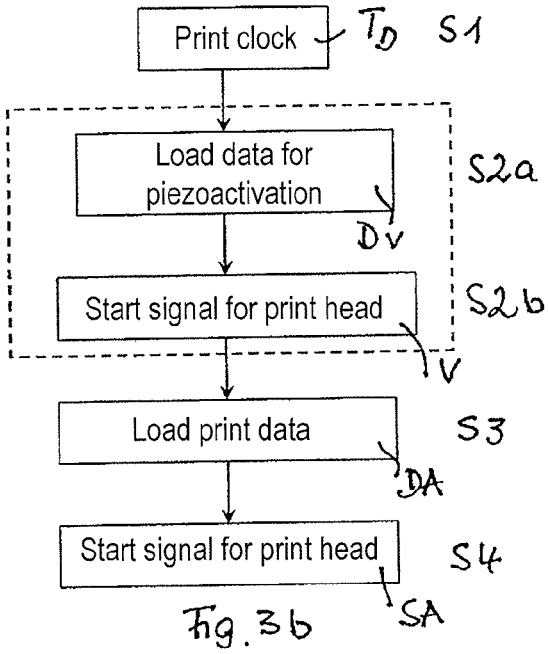

How the printing workflow in the printer controller 2 is to be changed in order to achieve this goal results from FIG. 3*a*, 3*b*. Without the exemplary embodiment (FIG. 3*a*), given the occurrence of a print clock pulse $T_D$ (Step S1) print data DA are loaded into the print head 5 (Step S2) and the printing is then executed (Step S3, FIG. 3*a*). Given use of the exemplary embodiment (FIG. 3*b*), given the occurrence of a print clock pulse $T_D$ (Step S1) data $D_V$ for the activation of a vibration cycle are loaded into the print head 5 (Step S2*a*), a vibration pulse V is provided at the print head 5 (Step S2*b*) so that the piezoactivators implement vibrations but no ink droplets are output, and only subsequently are print data DA loaded into the print head (Step S3) and the printing started (Step S4).

Given the printing interruptions of the printing operation, the time delay of the generation of the print dots on the printing substrate web 3 is so small that the relative errors that thereby arise are not disruptive.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to execute a printing interruption in a printing operation of an ink printing system with at least one printing apparatus, in which a printing substrate is printed to with a printing unit with at least one print head, and depending on a feed of the printing substrate, print clock pulses are generated with aid of a sensor arranged before the printing unit of the printing apparatus, said print clock pulses being supplied to a printer controller, comprising the steps of:

during the printing interruption in which a feed speed of the printing substrate web comes from a speed for said printing operation to a standstill, given occurrence of a print clock pulse sending with the printer controller at least one vibration pulse to the at least one print head to trigger vibration oscillations without ejecting ink before said printer controller loads print data associated with the print clock pulse into the at least one print head;

sending a print-start signal to said at least one print head during said interruption; and after said standstill, the feed speed of the printing substrate web is accelerated again upon resumption of the printing operation.

2. The method according to claim 1 in which the printing unit has a plurality of print heads and wherein a vibration pulse is supplied only to print heads for which print data exists.

3. A method to execute a printing interruption in a printing operation of an ink printing system with at least one print apparatus, in which a printing substrate is printed to with a printing unit with at least one print head, comprising the steps of:

during the printing interruption in which a feed speed of the printing substrate web comes from a speed for said printing operation to a standstill, sending at least one vibration pulse to the at least one print head to trigger vibration oscillations without ejecting ink before print data is loaded into the at least one print head;

then sending a print-start signal to said at least one print head during said interruption; and after said print data is loaded into the at least one print head said printing substrate at said standstill is accelerated for resumption of the printing operation.

* * * * *